US005765398A

United States Patent [19]

Bardisbanyan

[11] Patent Number: 5,765,398

[45] Date of Patent: Jun. 16, 1998

[54] METHOD AND APPARATUS FOR ASSEMBLING STONES IN JEWELRY

[75] Inventor: Vahran Bardisbanyan, Encino, Calif.

[73] Assignee: Marquesa, Inc., Van Nuys, Calif.

[21] Appl. No.: 740,851

[22] Filed: Nov. 4, 1996

[51] Int. Cl.[6] ..... A44C 17/02

[52] U.S. Cl. ..... 63/26; 63/28; 63/15

[58] Field of Search ..... 63/26, 27, 28, 63/15; 29/10, 896.41, 896.411, 896.412, 455.1; 228/132, 120, 189

[56] References Cited

U.S. PATENT DOCUMENTS 4,292,818 10/1981 Vitau ..... 29/10
4,543,698 10/1985 Plantureux ..... 29/10

*Primary Examiner*—Kien T. Nguyen
*Attorney, Agent, or Firm*—Levisohn, Lerner, Berger & Langsam

[57] ABSTRACT

A combination of a connecting or assembly member, a gemstone and an item of jewelry in which the assembly or connecting member connects the gemstone to the jewelry is disclosed. The connecting member comprises a projecting pin which passes through a corresponding small hole in the surface of the jewelry. The gemstones are placed in apertures, and the size of the aperture is smaller than that of the stone so that the stone nests into the aperture. The connecting members include projecting pins which pass through a corresponding small hole near the respective apertures and cold soldering is employed to secure the projecting pin in place thereby securing each stone in place in the jewelry.

27 Claims, 3 Drawing Sheets

FIG. 1
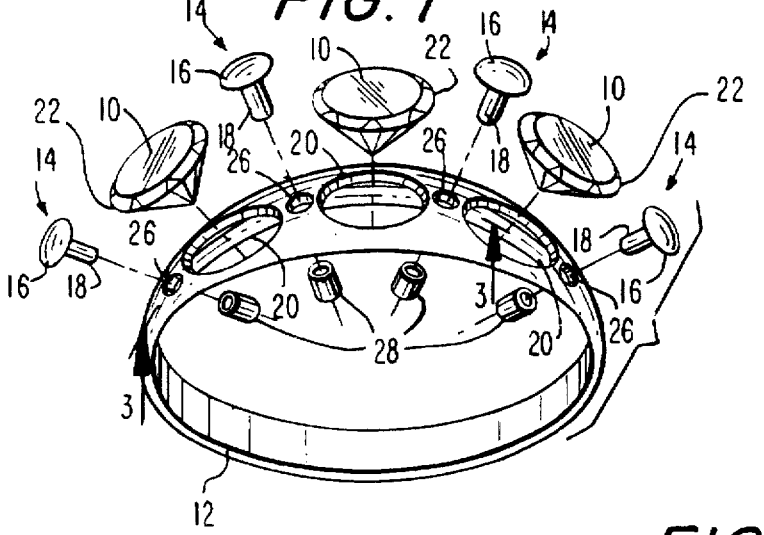
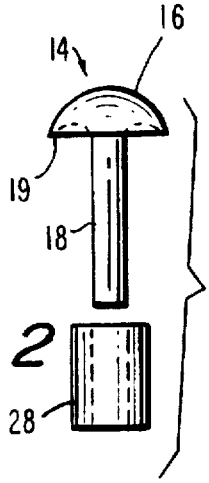
FIG. 2
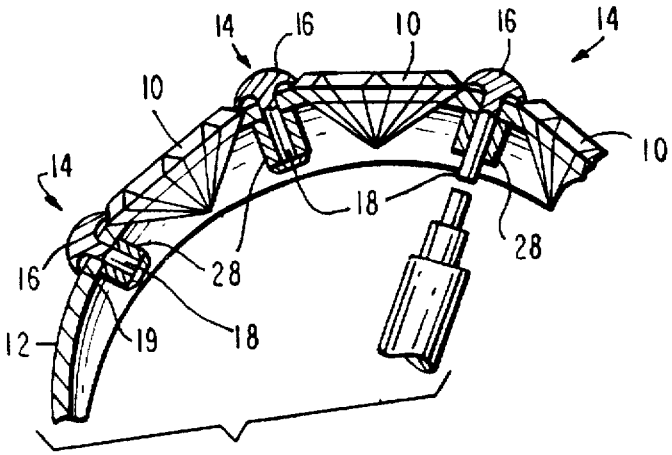
FIG. 3
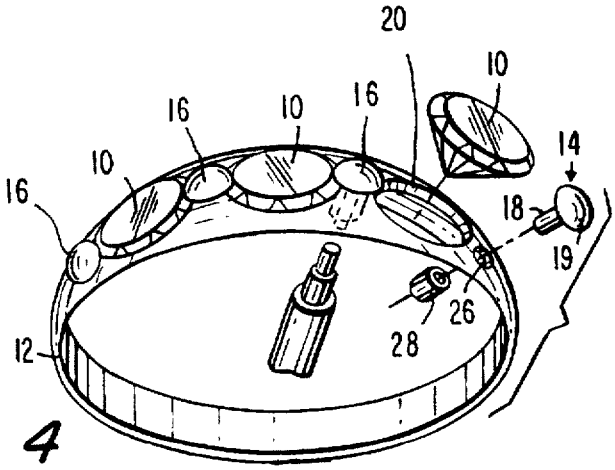
FIG. 4

METHOD AND APPARATUS FOR ASSEMBLING STONES IN JEWELRY

BACKGROUND OF THE INVENTION

The present invention relates to a new and novel method and apparatus for setting precious stones in jewelry rings or the like and is especially adapted to setting stones in round structural elements such as rings, bracelets, earrings, etc.

Stone setting is a highly-skilled art. In fine jewelry, precious and non-precious stones are often set in prongs formed in the jewelry. Skilled workers are required to perform such setting operations, and sometimes such stones can be damaged. Since labor is an expensive element in the manufacture of jewelry, various approaches have been employed to simplify the assembly of jewelry, especially fine jewelry employing precious and non-precious stones.

In the conventional prior practice, each stone is mounted in its own housing or prong setting. If two or more stones are to be connected, then mountings are linked in an article of jewelry.

An object of this invention is to provide an improved method of assembling colored, precious and semi-precious stones in gold and silver jewelry.

Another object of this invention is to simplify the assembly procedure so as to utilize workers of lower skill.

Yet another object of this invention is to provide such an apparatus and method which reduces the cost of assembly of gold and silver jewelry.

Other objects, advantages and features of this invention will become more apparent from the following description.

SUMMARY OF THE INVENTION

In accordance with the principles of this invention, precious and non-precious stones are set in round jewelry such as rings, earrings and the like by providing apertures in the surface of the jewelry onto which the stones are placed. The size of the apertures is smaller than the stone so that the stone nests in the aperture. The ring or jewelry structure located between the apertures provides a bearing surface and assembly members are pushed on top of each stone to create a downward pressure on the stones. Each assembly member comprises a projecting pin which passes through a corresponding small hole near the respective apertures. Cold soldering is employed to secure the projecting pin in place, thereby securing each stone in place in the jewelry. Different structural forms and shapes for the holding members are provided, and different stone shapes can be accommodated.

BRIEF DESCRIPTION OF THE DRAWINGS

FIG. 1 is an exploded perspective view of the elements of the present invention prior to assembly.

FIG. 2 is a side view of a channel member and corresponding tube into which the channel member is located to secure the same to the jewelry ring.

FIG. 3 is a sectional view taken along lines 3—3 of the ring of FIG. 1 with some of the elements already mounted in position;

FIG. 4 is another perspective view illustrating additional stones set in place pursuant to the method and apparatus of FIGS. 1 through 3.

DETAILED DESCRIPTION

Figure 5:
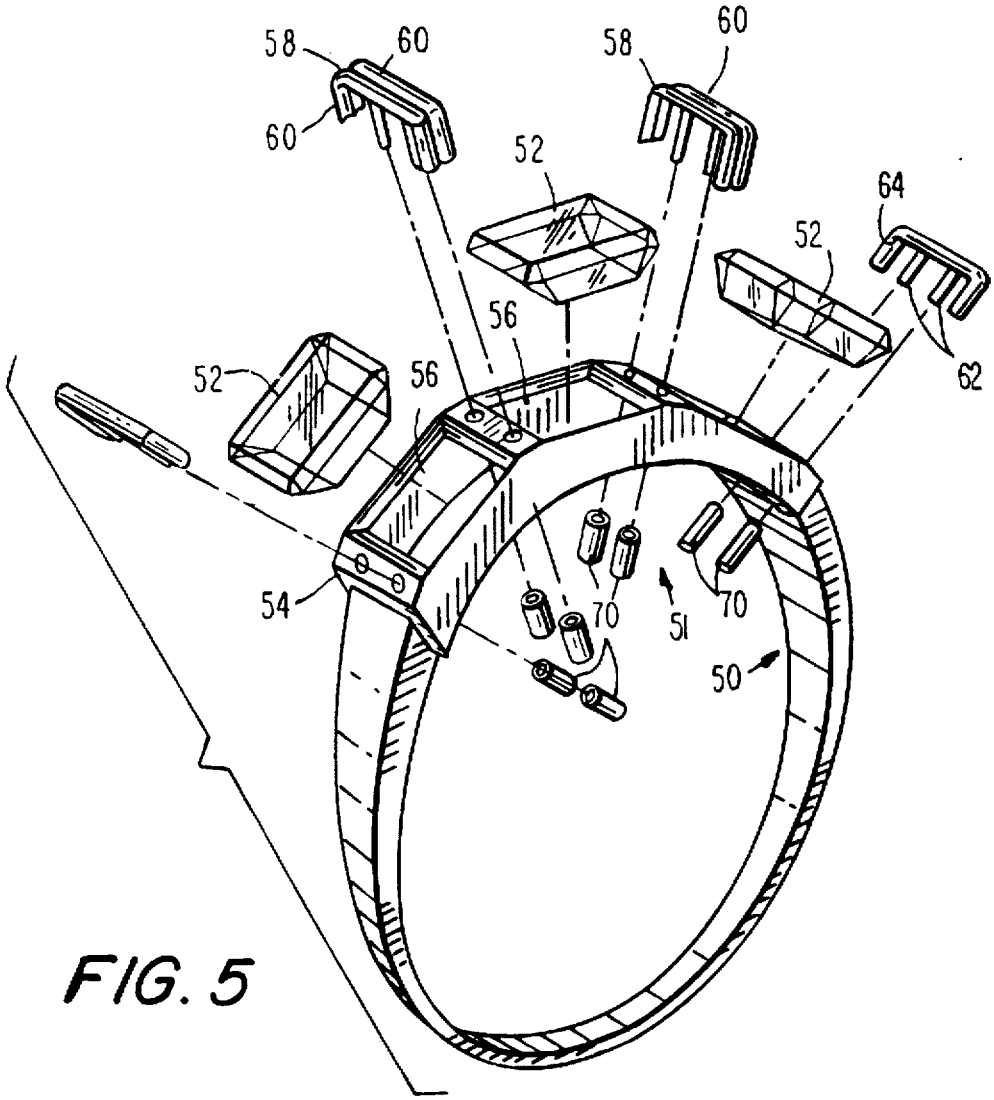
FIG. 5 is an exploded perspective view of another embodiment of the present invention with a different type jewelry ring, different stones and different assembly members.
Figure 6:
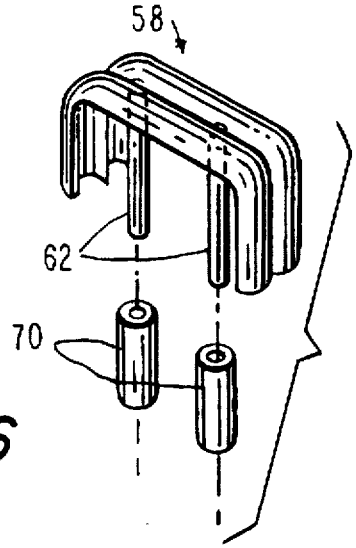
FIG. 6 is a view of the assembly member and corresponding connectors used to assemble the stone as in to FIG. 5.

FIGS. 1 through 4 illustrate a first embodiment of the present invention in which stones 10, preferably oval are secured to a ring 12 by assembly members 14. Each assembly member 14 resembles a tack and comprises a rounded semi-spherical head 16 connected to a center pin 18 which provides a general mushroom shape. The head 16 has a lower annular bearing surface 20.

The ring 12 is relatively thin-walled. Apertures 20 having the approximate shape of the stones to be set therein are drilled or otherwise formed by casting in the ring structure. The size of the apertures 20 roughly corresponds to slightly less than the size of the girdle 22 of each of the stones. To attach the stones to the ring, a first stone 10 is placed in corresponding aperture 20 and a first tack 14 is placed through a small hole 26 located in the ring near adjacent aperture 20. Pin 18 fits through hole 26. The stone 10 is set in the aperture 20, and tack or assembly member 14 is pressed down on top of the stone to hold the stone in place. A sleeve or tubing 28 is slid on the pin 16 under the ring. A cold soldering or fusion welding process is employed to attach pin 16 to sleeve 28. Such tool uses cold soldering and maybe a tool known as Tack 3 sold by ABI of 200 Jefferson Boulevard, Warwick, R.I. Cold fusion welding is a process which securely joins metal members together without the use of significant heat. By avoiding the use of significant heat in the assembly of jewelry elements, potential damage to the gemstones, gold and/or silver is avoided while the structural assembly is formed rigid.

In order to assemble three stones 10 as in FIG. 1, each of the tacks 14 is assembled sequentially one side to the other after a prior sequential tack is secured in place. Each stone is located beneath the respective annular bearing surfaces of each respective pairs of said tacks on opposite ends of the stone. The cold soldering process is illustrated in FIGS. 1–4, and the size of the tube or sleeve is small enough so that it does not interfere with the wearing of the ring. As an alternate embodiment, each hole 26 may itself terminate in a downwardly projecting angular flange or sleeve into which the respective pin would fit, so as not to eliminate the need for a separate sleeve. As illustrated in FIG. 4, the stones 10 are readily, quickly and effectively secured to the ring to provide an attractive appearance without need for expert jewelers to assemble the stones. By eliminating the conventional prong approach, significant savings in time, effort and expense is realized.

FIGS. 5 through 9 illustrate yet another embodiment of the present invention in which the assembly members have a different shape and are used to secure octagon stones to a ring.

Figure 7:
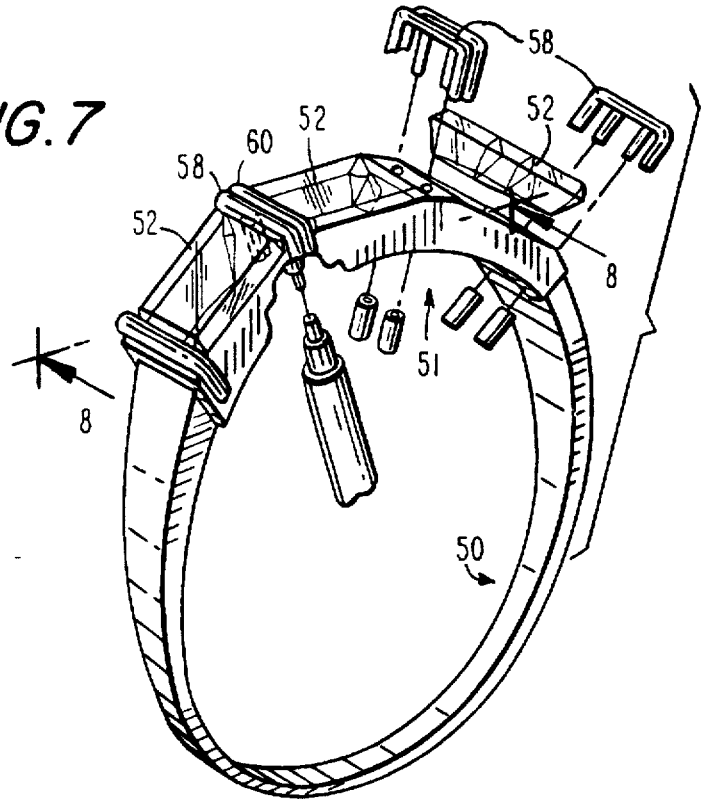
FIG. 7 is another exploded perspective view illustrating the first and second of said stones being attached to a ring in accordance with the method and apparatus of this invention.
Figure 8:
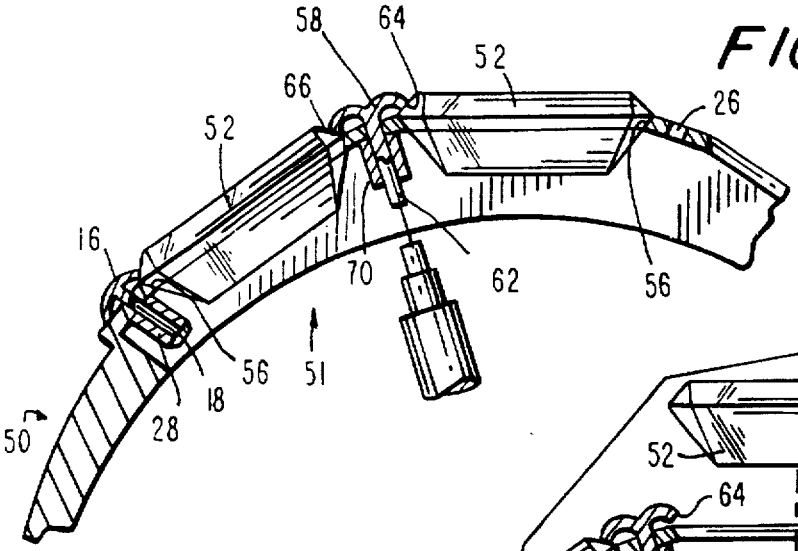
FIG. 8 is a partial side sectional view along lines 8—8 of FIG. 7 with some of the elements already mounted in position.
Figure 9:
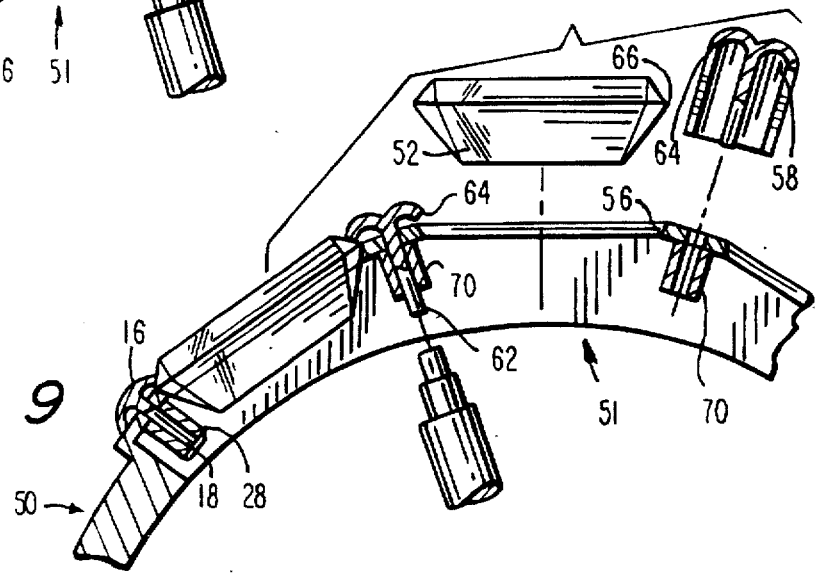
FIG. 9 is a view similar to FIG. 8 showing the process of attaching stones to the ring.

FIG. 5 illustrates a ring 50 having a head portion 51 adapted to receive three stones 52 between four assembly points 54. Each stone is an octagon and three recesses or apertures 56 are formed in the head of the ring 50. The assembly or connecting members 58 comprise pairs of parallel support bars 60 of a downward U-shape with a pair of projecting pins 62 depending downward therefrom. The edges 64 of the connecting members straddle the outer sides 66 of the respective octagon marquis stones and are tightly pressed against the respective side edges 68 of the head 51, so as to form a bearing surface holding the stone firmly into holes 69 formed at assembly points 54. The holes 69 are formed as pieces between respective apertures 56 to receive the pairs of pins 62 formed in connecting member 58. Sleeves or tubes 70 are slid on pins 62 at the underside of each of the holes 69. As illustrated in FIG. 7, cold soldering is employed to attach each sleeve to each pin to securely assemble and hold the stone against the ring. During assembly, the connecting members 58 of FIGS. 5 through 9 are firmly pressed down on the respective stones pressing against the respective portion of the stones so as to hold the cold soldering is employed to fixedly connect the connecting members to the sleeves.

This invention has been described with reference to several embodiments. Other shapes or forms for the connecting members which bear against the stones holding them in the apertures in the rings may be employed. Further, the invention has been described with reference to jewelry rings, but other round jewelry structures such as bracelets or the like could employ the assembly apparatus and method of the present invention. Further, the assembly of precious and non-precious stones to jewelry may also be employed if the jewelry were flat and not round such as found in pendants or the like with the assembly of the stones still using the same pressure with the connecting members bearing against respective surfaces of the stones to hold the stones are in respective apertures as the cold soldering process is employed.

I claim:

1. A combination of a gem stone, an item of jewelry and a connecting member to secure said gemstone to said item of jewelry, said combination comprising:

said item of jewelry having a surface to which said gemstone is to be secured, said surface having a longer and shorter dimension which could be interchangeable if the surface is square, said gemstone having a profile which generally approximates the girdle of the gemstone, said gemstone having opposite ends in the general direction of the longer dimension of said surface, said gemstone having an upper surface and a lower surface, said surface of said item of jewelry comprising an aperture having an opening similarly shaped and slightly smaller than the profile of said gemstone, said aperture having ends thereof corresponding to said ends of said gemstone so that said lower surface of said gemstone projects through said aperture, said surface further comprising at least an additional aperture located adjacent an end of said gemstone, a connecting member having a bearing surface which bears on the upper surface of said gemstone, said connecting member comprising a pin extending downwardly through said additional aperture, a sleeve located below said surface, said connecting member being pushed downwardly on said gemstone to hold said gemstone in place, said sleeve being cold soldered to said pin to secure said connecting member in place.

2. A combination as set forth in claim 1, wherein said item of jewelry is a ring.

3. A combination as set forth in claim 2, wherein said surface further comprises at least an additional aperture at either end of said gemstones.

4. A combination as set forth in claim 3, wherein said connecting member comprises a tack with a head and a central pin depending therefrom.

5. A combination as set forth in claim 3 wherein said connecting member comprises a bar which straddles the gemstone.

6. A combination as set forth in claim 3 wherein said connecting member comprises a bar which straddles the gemstone.

7. A combination as set forth in claim 5 wherein said connecting member comprises a pair of bars so as to have each respective bar bear upon a respective gemstone set next to each other.

8. A combination as set forth in claim 2 wherein said connecting member comprises a bar which straddles the gemstone.

9. A combination as set forth in claim 2 wherein said connecting member comprises a pair of bars so as to have each respective bar bear upon a respective gemstone set next to each other.

10. A combination as set forth in claim 2 wherein said gemstones are connected to form a row of gemstones.

11. A combination as set forth in claim 2, wherein said sleeve is separate from said connecting member and is slid on said connecting member beneath said surface.

12. A combination as set forth in claim 1, wherein said item of jewelry is a pendant.

13. A combination as set forth in claim 12 wherein said connecting member comprises a bar which straddles the gemstone.

14. A combination as set forth in claim 12 wherein said connecting member comprises a pair of bars so as to have each respective bar bear upon a respective gemstone set next to each other.

15. A combination as set forth in claim 12 wherein said gemstones are connected to form a row of gemstones.

16. A combination as set forth in claim 12, wherein said sleeve is separate from said connecting member and is slid on said connecting member beneath said surface.

17. A combination as set forth in claim 1, wherein said surface further comprises at least an additional aperture at either end of said gemstones.

18. A combination as set forth in claim 17, wherein said connecting member comprises a tack with a head and a central pin depending therefrom.

19. A combination as set forth in claim 17 wherein said connecting member comprises a bar which straddles the gemstone.

20. A combination as set forth in claim 17 wherein said connecting member comprises a pair of bars so as to have each respective bar bear upon a respective gemstone set next to each other.

21. A combination as set forth in claim 1 wherein said connecting member comprises a pair of bars so as to have each respective bar bear upon a respective gemstone set next to each other.

22. A combination as set forth in claim 1 wherein said gemstones are connected to form a row of gemstones.

23. A combination as set forth in claim 1 wherein said connecting member comprises a bar and said pin comprises a pair of pins, wherein said at least an additional aperture comprises two apertures through which said pair of pins in said connecting member pass to secure said gemstone to said item of jewelry.

24. A combination as set forth in claim 1, wherein said sleeve is separate from said connecting member and is slid on said connecting member beneath said surface.

25. A combination as set forth in claim 1, wherein said sleeve is integrally formed from the undersurface of said surface of said item of jewelry.

26. A combination as set forth in claim 1, wherein said gemstone comprises an oval gemstone, said aperture comprises an oval shape, and said item of jewelry comprises a jewelry ring, wherein said apparatus connects a row of said oval gemstones onto the surface of said ring.

27. A combination as set forth in claim 1, wherein said stones comprise marquis stones, said item of jewelry comprises a jewelry ring, and said connecting members bear on the ends of said marquis stones to hold said stones in place on said jewelry ring.

* * * * *